US007311500B2

(12) United States Patent
Rongong et al.

(10) Patent No.: US 7,311,500 B2
(45) Date of Patent: Dec. 25, 2007

(54) TURBOMACHINE BLADE

(75) Inventors: Jem A Rongong, Stockport (GB); Geoffrey R Tomlinson, Stockport (GB)

(73) Assignee: Rolls-Royce plc, London (GB)

( * ) Notice: Subject to any disclaimer, the term of this patent is extended or adjusted under 35 U.S.C. 154(b) by 199 days.

(21) Appl. No.: 10/609,640

(22) Filed: Jul. 1, 2003

(65) Prior Publication Data

US 2004/0018091 A1 Jan. 29, 2004

(30) Foreign Application Priority Data

Jul. 26, 2002 (GB) ..... 0217337.5

(51) Int. Cl.
*F01D 5/16* (2006.01)

(52) U.S. Cl. ..... 416/230; 416/241 A; 416/500

(58) Field of Classification Search ..... 416/144, 416/224, 229 R, 230, 232, 233, 241 A, 500, 416/229 A See application file for complete search history.

(56) References Cited

U.S. PATENT DOCUMENTS

| | | | | |
|---|---|---|---|---|
| 3,357,850 A | * | 12/1967 | Baker | 416/229 A |
| 3,386,927 A | * | 6/1968 | Rosecrans et al. | 521/112 |
| 3,699,623 A | | 10/1972 | Kreider | |
| 5,056,738 A | | 10/1991 | Mercer | |
| 5,913,661 A | * | 6/1999 | Panovsky et al. | 416/229 A |
| 5,931,641 A | | 8/1999 | Finn | |
| 6,224,341 B1 | | 5/2001 | Fricke | |
| 6,669,447 B2 | * | 12/2003 | Norris et al. | 416/224 |

FOREIGN PATENT DOCUMENTS

| | | |
|---|---|---|
| EP | 0 926 312 A | 6/1999 |
| GB | 713 160 SP | 8/1954 |
| GB | 893 787 SP | 4/1962 |
| GB | 2 026 622 A | 2/1980 |
| GB | 2 371 095 A | 7/2002 |

* cited by examiner

*Primary Examiner*—Christopher Verdier
(74) *Attorney, Agent, or Firm*—W. Warren Taltavull; Manelli Denison & Selter PLLC

(57) ABSTRACT

A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge. The concave metal wall portion and the convex metal wall portion form a continuous integral metal wall. The aerofoil portion has a hollow interior defined by at least one internal surface and the hollow interior of the aerofoil portion is at least partially filled with a vibration damping and stiffening system that comprises a vibration damping material. The vibration damping material is bonded to the at least one internal surface and the vibration damping and stiffening system comprises a variation of material properties between the wall portions.

26 Claims, 3 Drawing Sheets

TURBOMACHINE BLADE

FIELD OF THE INVENTION

The present invention relates to a turbomachine blade, for example a compressor blade for a gas turbine engine and in particular to a fan blade for a gas turbine engine.

BACKGROUND OF THE INVENTION

Conventional narrow chord fan blades for gas turbine engines comprise solid metal.

One conventional wide chord fan blade comprises a concave metal wall portion, a convex metal wall portion and a honeycomb between the two metal wall portions. This wide chord fan blade is produced by hot forming the wall portions into concave and convex shapes respectively, placing the honeycomb between the metal wall portions and brazing, or activated diffusion bonding, the metal wall portions together around the honeycomb. The interior of the fan blade is evacuated.

Another conventional wide chord fan blade comprises a concave metal wall portion, a convex metal wall portion and metal walls extending between the two wall portions. Placing a metal sheet between two tapered metal sheets and diffusion bonding the sheets together at predetermined positions to form an integral structure produces this wide chord fan blade. Then inert gas is supplied into the interior of the integral structure to hot form the integral structure into a die to produce the concave and convex walls and the walls extending between the concave and convex walls. The interior of the fan blade is evacuated.

A disadvantage of a wide chord fan blade is that it is not as stiff as a narrow chord fan blade. The reduced stiffness results in an increased risk of stalled flutter within the operating range of the gas turbine engine and an increased susceptibility to other forms of vibration. A further disadvantage of the wide chord fan blade is that it is very expensive and time consuming to produce.

One solution to damping the vibrations of a fan blade is to fill the interior with a viscoelastic material core, bonded to the interior of the wall portions, as disclosed in the UK Patent Application GB0130606.7. However, the structural requirements of a fan blade and thus the core are to resist rotational, vibrational and impact loads. A disadvantage of this system is that rotational and impact loads require a core of high strength and high stiffness, whereas for vibration damping the core is preferably of a low modulus. A further disadvantage is that the damping ability of the viscoelastic material core is compromised by the necessity to reduce the parasitic weight, which is achieved by inclusion of microbubbles.

SUMMARY OF THE INVENTION

Accordingly the present invention seeks to provide a novel turbomachine blade that reduces, preferably overcomes, the above mentioned problems.

Accordingly the present invention provides a turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material, the vibration damping material being bonded to the at least one internal surface and wherein the vibration damping and stiffening system comprises a variation of material properties between the wall portions.

Preferably, the whole of the interior of the aerofoil portion is filled by vibration damping and stiffening system.

Preferably, the vibration damping and stiffening system comprises a damping layer and a stiffening core, the damping layer is disposed to the internal surface and the stiffening core is disposed within the damping layer.

Alternatively, a second damping layer in provided between the first damping layer and the stiffening core.

Preferably, the damping layer is 1.0 mm thick, alternatively the damping layer is between 0.05 and 3.0 mm thick.

Preferably, the first damping layer comprises a modulus of 10 $N/mm^2$, but alternatively the first damping layer comprises a modulus between 0.5 and 100 $N/mm^2$.

Preferably, the stiffening core comprises a modulus of 1000 $N/mm^2$, alternatively the stiffening core comprises a modulus between 200 and 10000 $N/mm^2$.

Preferably, the second damping layer comprises a modulus between that of the first damping layer and that of the stiffening core.

Preferably, the second damping layer comprises a modulus of 80 $N/mm^2$.

Alternatively, at least three damping layers are provided and each successive damping layer increases when moving from the interior surface to the core.

Preferably, the vibration damping layer comprises a polymer and the polymer is a polymer blend comprising Bisphenol A-Epochlorohydrin, an amine hardener and branched polyurethane.

Preferably, the vibration damping material also comprises a structural hardener, but alternatively the vibration damping layer comprises a liquid crystal siloxane polymer.

Preferably, the stiffening core comprises a syntactic material.

Preferably, the stiffening core comprises Bisphenol A-Epochlorohydrin mixed with an aliphatic polyamine.

The stiffening core may comprise strengthening fibres from the group comprising glass, carbon, amide or modified amide.

Preferably, the vibration damping and stiffening system contains glass microspheres, polymer microspheres or a mixture of glass microspheres and polymer microspheres.

Alternatively, the vibration damping and stiffening system comprises a material that increases in stiffness from the interior surfaces to the centre of the hollow interior. Preferably, the vibration damping and stiffening system comprises a material that decreases in density from the interior surfaces to the centre of the hollow interior. Preferably, the vibration damping and stiffening system comprises a syntactic material.

Preferably, the turbomachine blade is a compressor blade or a fan blade. Preferably, the concave and convex metal wall portions comprise titanium or a titanium alloy.

Preferably, a method of manufacturing a turbomachine blade from at least two metal workpieces comprises the steps of:—forming at least two metal workpieces, applying stop off material to a predetermined area of a surface of at least one of the at least two metal workpieces, arranging the workpieces in a stack such that the stop off material is between the at least two metal workpieces, heating and applying pressure across the thickness of the stack to diffusion bond the at least two workpieces together in areas other than the preselected area to form an integral structure, heating and internally pressurising the interior of the integral structure to hot form the at least two metal workpieces into an aerofoil shape to form a turbomachine blade having a hollow interior defined by at least one internal surface, cleaning the internal surface of the hollow interior of the turbomachine blade, supplying a vibration damping and stiffening system into the hollow interior of the turbomachine blade and bonding the vibration damping and stiffening system to the internal surface, and sealing the hollow interior of the turbomachine blade.

BRIEF DESCRIPTION OF THE DRAWINGS

The present invention will be more fully described by way of example with reference to the accompanying drawings in which.

DETAILED DESCRIPTION OF THE INVENTION

Figure 1:
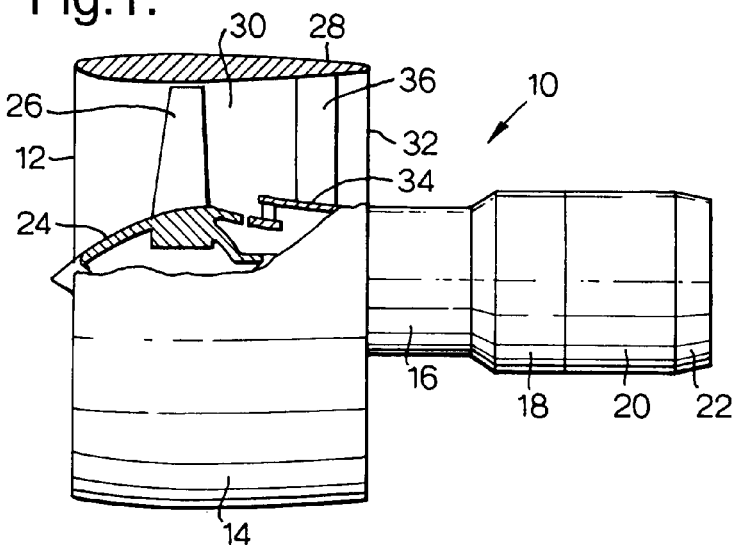
FIG. 1 shows a gas turbine engine having a blade according to the present invention.

A turbofan gas turbine engine 10, as shown in FIG. 1, comprises in axial flow series an inlet 12, a fan section 14, a compressor section 16, a combustion section 18, a turbine section 20 and an exhaust 22. The fan section 14 comprises a fan rotor 24 carrying a plurality of equi-angularly-spaced radially outwardly extending fan blades 26. A fan casing 28 that defines a fan duct 30 surrounds the fan blades 26 and the fan duct 30 has an outlet 32. The fan casing 28 is supported from a core engine casing 34 by a plurality of radially extending fan outlet guide vanes 36.

The turbine section 20 comprises one or more turbine stages to drive the compressor section 18 via one or more shafts (not shown). The turbine section 20 also comprises one or more turbine stages to drive the fan rotor 24 of the fan section 14 via a shaft (not shown).

Figure 2:
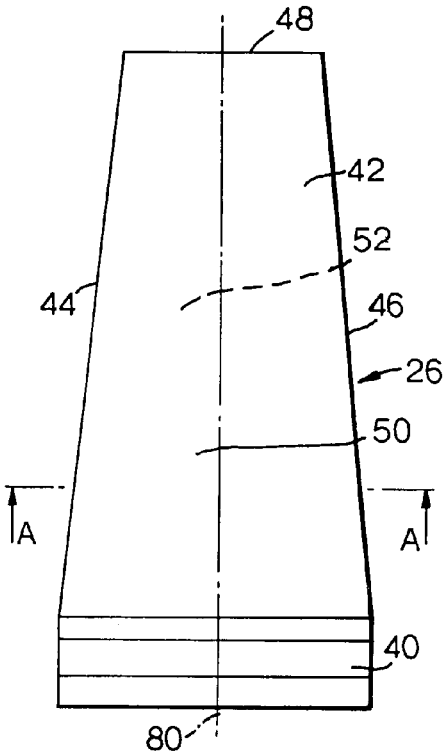
FIG. 2 is an enlarged view of a fan blade according to the present invention.
Figure 3:
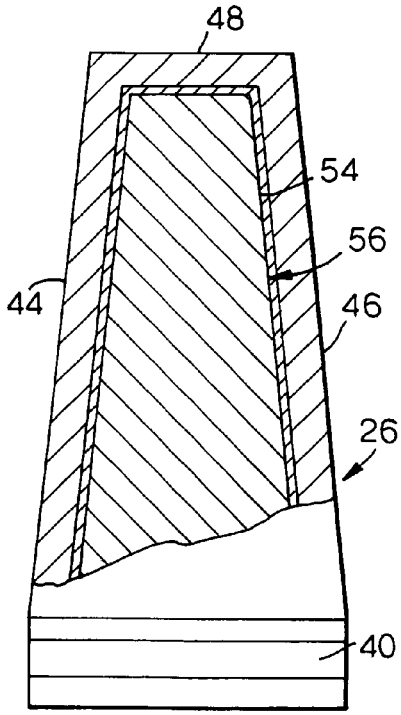
FIG. 3 is a cut away view through the fan blade shown in FIG. 2.
Figure 4:
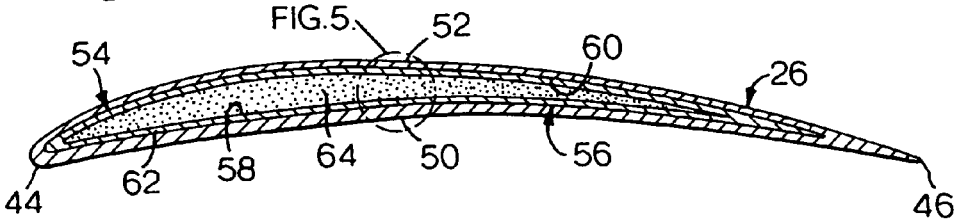
FIG. 4 is a cross-sectional view in the direction of arrows A-A in FIG. 2.

One of the fan blades 26 is shown in more detail in FIGS. 2, 3 and 4. The fan blade 26 comprises a root portion 40 and an aerofoil portion 42. The root portion 40 comprises a dovetail root, a firtree root, or other suitably shaped root for fitting in a correspondingly shaped slot in the fan rotor 26. The aerofoil portion 42 has a leading edge 44, a trailing edge 46 and a tip 48. The aerofoil portion 42 comprises a concave wall 50, which extends from the leading edge 44 to the trailing edge 46, and a convex wall 52 that extends from the leading edge 44 to the trailing edge 46. The concave and convex walls 50 and 52 respectively comprise a metal for example a titanium alloy. The aerofoil portion 42 has a hollow interior 54 and at least a portion, preferably the whole, of the hollow interior 54 of the aerofoil portion 42 is filled with a vibration damping and stiffening system 56.

One prior art solution to damping the vibrations of a fan blade 26 is to fill the interior 54 with a viscoelastic material core, bonded to the interior surfaces 58, 60 of the wall portions 50, 52, as disclosed in the UK Patent Application GB0130606.7 of the present Applicant. The structural requirements of a fan blade 26 and thus the vibration damping core are to resist rotational, vibrational and impact loads. A disadvantage of this system is that rotational and impact loads require a core comprising relatively high strength and high stiffness, whereas for vibration damping the core is preferably of a relatively low modulus. A further disadvantage is that the damping ability of the viscoelastic material core is compromised by the necessity to reduce its parasitic weight, which is achieved by inclusion of microbubbles therein.

The present invention overcomes these disadvantages by providing a vibration damping and stiffening system 56 within the hollow interior 54, the vibration damping and stiffening system 56 comprising varying material properties, which are arranged to both damp vibrations and provide the blade with increased stiffness.

Figure 5:
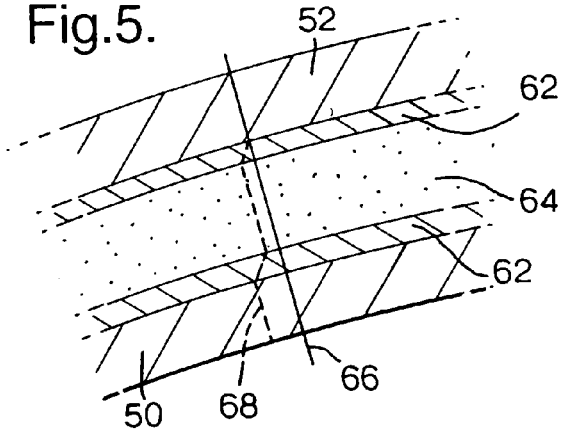
FIG. 5 is an enlargement of part of the cross-sectional view of FIG. 4.

In one embodiment of the present invention and with particular reference to FIGS. 4 and 5, a vibration damping layer 62 is placed immediately adjacent and bonded to the interior surfaces 58, 60. The vibration damping layer 62 is bonded to and surrounds a rigid core 64. The damping layer 62 is a relatively low modulus material. The vibration damping layer 62 comprises a material having viscoelasticity. Viscoelasticity is a property of a solid or liquid which when deformed exhibits both viscous and elastic behaviour through the simultaneous dissipation and storage of mechanical energy. Suitable materials for the damping layer 62 comprise a polymer blend, a structural epoxy resin and liquid crystal siloxane polymer.

One particular and preferred polymer blend comprises, per 100 grams: 62.6% Bisphenol A-Epochlorohydrin (Epophen resin ELS available from Borden Chemicals, UK); 17.2 grams Amine hardener (Laromin C260 available from Bayer, Germany); 20.2 grams of branched polyurethane (Desmocap 11 available from Bayer, Germany). This polymer blend is then mixed in a mass ratio of 1:1 with a structural epoxy resin, preferably Bisphenol A-Epochlorohydrin mixed with an amine-terminated polymer (e.g. Adhesive 2216 available from 3M).

The core 64 is a relatively high modulus and low density material and is therefore relatively light weight. A preferable material is Bisphenol A-Epochlorohydrin mixed with an aliphatic polyamine and a suitable quantity of density-reducing glass or polymer microbubbles. It is preferable for the glass transition temperature of this material to be above 50° C. and a suitable proprietary product is Epocast 1637, which is available from Vantico, UK. There are many other usable materials for the core 64, all of which may have their density reduced with microbubbles and are known as syntactic material. These syntactic material may be strengthened using glass, carbon or aramid fibres.

It is desirable for the damping layer 62 to comprise a modulus of elasticity in the range 0.5-100 MPa and the modulus of elasticity of the core 64 to be above 200 MPa, but preferably at least 500 MPa and as much as 10000 MPa. For the polymer blend damping layer, described above, the modulus is approximately 10 MPa and a Poisson's ratio of approximately 0.45 and for the core (Epocast 1637) 700 MPa and 0.40 respectively.

In operation of the turbofan gas turbine engine 10 the vibration damping and stiffening system 56 in the hollow interior 54 damps vibrations of the fan blades 26. The vibration damping layer 62 damps the vibrations of the fan blade 26 by removing energy from the vibrations because of its viscoelasticity. It is known that there are many different modes of vibration experienced by a fan blade 26; however, all vibrations cause the blade 26 to bend in flexure. During flexure, at least part of each the concave and convex walls 50, 52 displace relative to one another in shear and this is shown in more detail in FIG. 5. Here it can be seen how an arbitrary datum or non-displaced line 66 is transformed to the dashed shear displaced line 68. Thus the vibrations of the fan blade 26 create shear strains that are transmitted substantially through the vibration damping layer 62, between the core and the wall portions 50, 52. These shear strains cause a proportion of the energy of vibration to be transmitted, or lost, as heat energy thereby damping vibrations of the fan blade 26. As the vibration damping layer 62 is relatively thin it can be of a relatively higher density material than the prior art teaches, as its total parasitic weight is significantly less.

For a fan blade 26 suitable for use in a Trent series aerospace engine as made by Rolls-Royce plc, the vibration damping layer 62 is 1.0 mm thick and comprises a density of 1.1 grams/cc, whereas the stiffening core is 25 mm thick and 0.47 grams/cc. However, the layer thicknesses will be suited to both fan blade 26 characteristics such as frequency modes and blade size.

The fan blade 26 is manufactured generally as described in UK Patent Application GB0130606.7, and the teaching of which are incorporated herein, except for the introduction of the vibration damping and stiffening system 56 material. A method of manufacturing a turbomachine blade from at least two metal workpieces comprising the steps of:—forming at least two metal workpieces, applying stop off material to a predetermined area of a surface of at least one of the at least two metal workpieces, arranging the workpieces in a stack such that the stop off material is between the at least two metal workpieces, heating and applying pressure across the thickness of the stack to diffusion bond the at least two workpieces together in areas other than the preselected area to form an integral structure, heating and internally pressurising the interior of the integral structure to hot form the at least two metal workpieces into an aerofoil shape to form a turbomachine blade having a hollow interior defined by at least one internal surface, cleaning the internal surface of the hollow interior of the turbomachine blade, supplying a vibration damping and stiffening system into the hollow interior of the turbomachine blade and bonding the vibration damping and stiffening system to the internal surface, and sealing the hollow interior of the turbomachine blade.

After the fan blade 26 is allowed to cool and the hollow interior 54 of the fan blade 26 is sequentially flushed with nitric acid, a neutraliser and water to remove all the stop off material, yttria, from the internal surfaces of the hollow interior 54 of the fan blade 26 and to prepare the interior surfaces 58 and 60 for bonding. Then the damping layer material 62 is supplied, through the pipe, into the hollow interior 54 of the fan blade 26 and against the interior surfaces 58 and 60 in a 1 mm thick layer. Preferably the damping layer material 62 is supplied through a pipe at the root end of the fan blade 26. The damping layer material 62 is allowed to cure in the fan blade 26 and to bond to the interior surfaces 58 and 60 of the hollow interior 54 of the fan blade 26. Once the damping layer 62 has cured the core 64 material is injected through the pipe. When the core 64 has cured the hollow interior 54 of the fan blade 26 is then sealed by welding across the pipe entry into the fan blade 26 to prevent the vibration damping and stiffening material 56 escaping from the fan blade 26.

This method of manufacturing the fan blade 26 is also advantageous in that it dispenses with the need for the third metal sheet that form the interconnecting walls of other known wide cord fan blades, thereby reducing the amount of titanium alloy used and reducing machining time. Additionally the temperature for hot forming the hot creep formed integral structure is less than that required for superplastic forming the third metal sheet.

Another method of placing the filler material is to inject both the damping layer and the core simultaneously through two coaxial tubes. The damping layer is injected through the outer tube and as it has a lower viscosity than the core, the more viscous core pushes the damping layer toward the interior walls.

Figure 6:
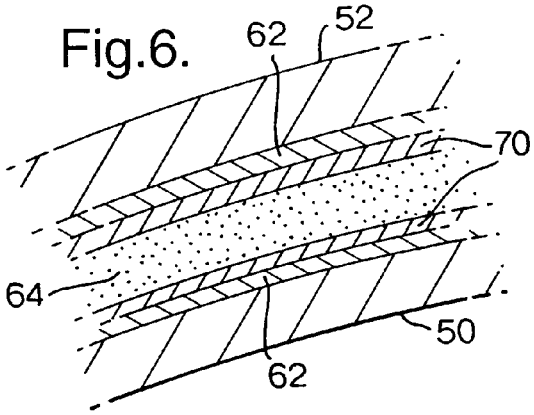
FIG. 6 is an enlargement of part of the cross-sectional view of a fan blade in accordance with a second embodiment of the present invention.

In another embodiment of the present invention and with reference to FIG. 6, a second damping layer 70 is disposed to the interior surface of the (first) damping layer 62, the core 64 then being placed in juxtaposition to this second damping layer 70. The second damping layer 70 comprises a modulus of 80 MPa, which is between the elastic modulus of the (first) damping layer 62 and the core 64. However, the second damping layer 70 may have a modulus between 20 and 100 MPa and is approximately 1.0 mm thick. A suitable material for the second damping layer 70 is a structural epoxy resin, preferably Bisphenol A-Epochlorohydrin mixed with an amine-terminated polymer (e.g. Adhesive 2216 available from 3M). Although in this embodiment it is preferable for the first and second damping layers to be 1.0 mm thick, a suitable range of thicknesses for either layer would be between 0.05 and 3.0 mm.

The second damping layer 70 is beneficial where elevated temperatures are present that may adversely affect the effectiveness of the first damping layer. Furthermore the second damping layer 70 may be used where a blade undergoes a number of different operations and is subject to a wider range of vibrational frequencies that require damping.

It is also possible to provide at least three damping layers and the modulus of each successive damping layer increases when moving from the interior surface to the core. Alternatively, the modulus of each successive damping layer decreases when moving from the interior surface to the core, thereby increasing the amount of strain within each layer as the stress reduces when approaching the centre-line of the blade. This enables more damping to occur throughout the vibration damping and stiffening system.

Figure 7:
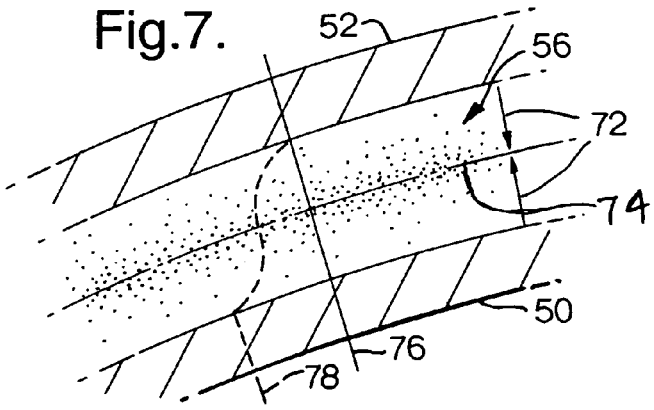
FIG. 7 is an enlargement of part of the cross-sectional view of a fan blade in accordance with a second embodiment of the present invention.

In a further embodiment of the present invention and with reference to FIG. 7, the vibration damping and stiffening material 56 comprises a viscoelastic material that has a modulus gradient across the hollow interior 54. Specifically, at the interior surfaces 58, 60 the modulus is relatively low and increasing in the direction of arrows 72. In a preferred example the modulus of the vibration damping and stiffening material 56 increases from 10 $N/mm^2$ at the interior surfaces to 1000 $N/mm^2$ at a centre line 74. The centre line 74 runs from the leading edge 44 to the trailing edge 46 and it is adjacent this centre line 74 that the vibration damping and stiffening material 56 is the stiffest having the greatest modulus and therefore provides the fan blade 26 with additional stiffening.

During flexure of the fan blade 26, at least part of each the concave and convex walls 50, 52 displace relative to one another in shear. In FIG. 7 it can be seen how a datum line 76, where the blade 26 is un-flexed, is transformed to the dashed shear displaced line 78, where the blade 26 is flexed. Thus the vibrations of the fan blade 26 create shear strains that are transmitted substantially through the portion of the material 56 closest to the interior surfaces 58, 60, between the core and the wall portions 50, 52. This shear strain causes a proportion of the energy of vibration to be transmitted, or lost, as heat energy thereby damping vibrations of the fan blade 26. This system is advantageous in that a broader range of vibration modes are damped and the weight of the system further optimised.

There are several methods of manufacture to achieve a modulus gradient across the hollow interior 54. One method comprises controlling the temperature during curing of the material so that there is a temperature gradient across the filler material.

Where a syntactic material is used for the vibration damping and stiffening material 56, a manufacturing method to achieve a modulus gradient across the hollow interior 54 comprises injecting the syntactic material into the hollow interior 54 and then rotating the blade 26 about its longitudinal axis 80 (as shown in FIG. 2). During rotation the microbubbles migrate towards the axis of rotation, thereby the material around the axis becomes less dense and that near the interior surfaces 58, 60 of the blade become denser. The inclusion of microbubbles to a material increases is stiffness, thus as the material near the centre-line 74 comprises substantially more microbubbles than near the interior surfaces it is substantially stiffer. This is particularly so where the microbubbles are made from glass.

Figure 8:
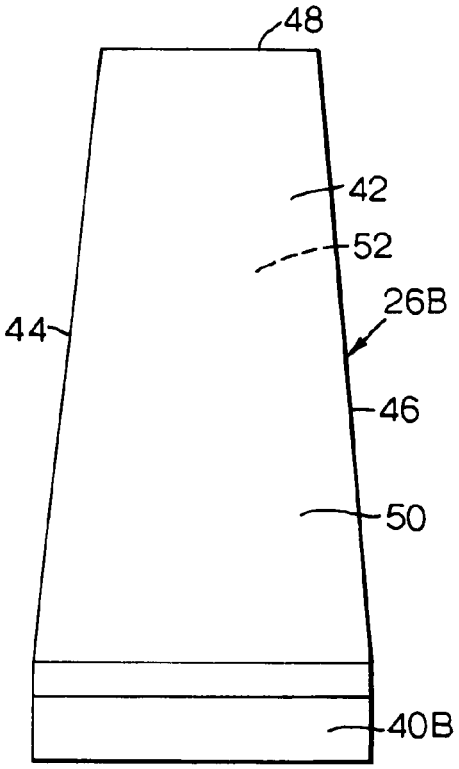
FIG. 8 is an enlarged view of an alternative fan blade according to the present invention.
Figure 9:
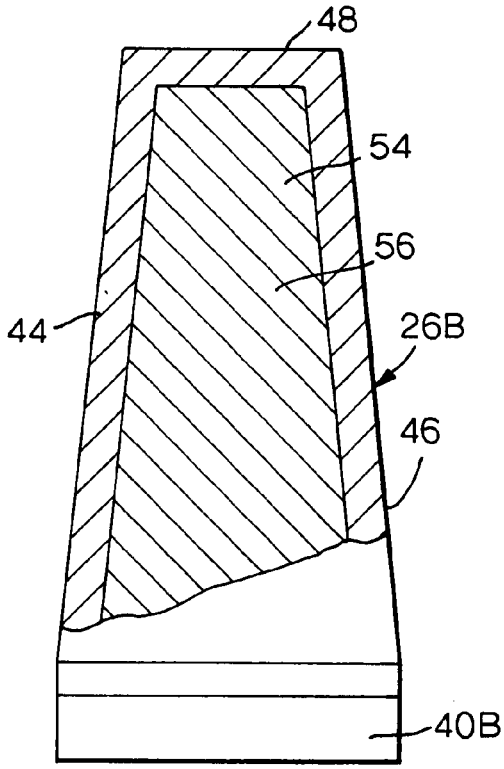
FIG. 9 is a cut away view through the fan blade in FIG. 8.

Another of the fan blades 26B is shown in more detail in figures 8 and 9. The fan blade 26B comprises a root portion 40B and an aerofoil portion 42. The root portion 40B comprises a shaped foot to enable, the fan blade 26B to be secured to the fan rotor 24 by friction welding, diffusion bonding or other suitable welding or bonding process, for example linear friction welding. The aerofoil portion 42 has a leading edge 44, a trailing edge 46 and a tip 48. The aerofoil portion 42 comprises a concave wall 50 that extends from the leading edge 44 to the trailing edge 46 and a convex wall 52 that extends from the leading edge 44 to the trailing edge 46. The concave and convex walls 50 and 52 respectively comprise a metal for example a titanium alloy. The aerofoil portion 42 has a hollow interior 54 and at least a portion, preferably the whole, of the hollow interior 54 of the aerofoil portion 42 is filled with a vibration damping and stiffening system 56 as herein described.

In the case of the fan blade 26 in FIGS. 2 to 7 the root portion 40 is machined to produce a dovetail root or a firtree root either before, or after, the vibration damping and stiffening system material 56 is supplied into the hollow interior 54 of the fan blade 26.

However, in the case of the fan blade 26B in FIGS. 8 and 9 the root portion 40B is friction welded or diffusion bonded to the fan rotor 26, for example by linear friction welding, and is subsequently heat treated before the vibration damping and stiffening system material 56 is supplied into the hollow interior 54 of the fan blade 26B.

The fan blades 26 and 26B have an advantage of having a continuous integral metal wall 50 and 52 around the vibration damping and stiffening system 56, which minimises the possibility of release of the vibration damping material 56 into the gas turbine engine 10. This also minimises the possibility of damage to other components of the gas turbine engine 10. The provision of the vibration damping and stiffening system 56 completely within the hollow interior 54 of the fan blades 26 and 26B, defined by the integral metal walls 50 and 52 allows the aerodynamic shape and the integrity of the fan blades 26 and 26B to be maintained. The shape and size of the hollow interior 54 and vibration damping and stiffening system 56 may be selected to control the weight of the fan blades 26 and 26B. The vibration damping and stiffening system 56 properties may be selected for the resonant frequency of the fan blades 26 and 26B or mode shape of the fan blades 26 and 26B.

The vibration damping and stiffening system 56 is easily incorporated into the fan blades 26 and 26B without impairing the aerodynamic shape or integrity of the fan blades 26 and 26B and without additional machining, forming or forging process steps.

Although the invention has been described with reference to a fan blade 26 it is equally applicable to a compressor blade and a turbine blade.

Although the invention has been described with reference to titanium alloy blades it is equally applicable to other metal alloy, metal or intermetallic blades.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material, the vibration damping material being bonded to the at least one internal surface and wherein a vibration damping and stiffening system comprises a variation of material properties between the wall portions wherein the vibration damping and stiffening system comprises a damping layer and a stiffening core, the damping layer is disposed on the internal surface and the stiffening core is disposed within the damping layer wherein a second damping layer comprises a modulus between that of a first damping layer and that of the stiffening core.

2. A turbomachine blade as claimed in claim 1 wherein the whole of the interior of the aerofoil portion is filled by the vibration damping and stiffening system.

3. A turbomachine blade as claimed in claim 1 wherein the second damping layer is provided between the first damping layer and the stiffening core.

4. A turbomachine blade as claimed in claim 3 wherein the second damping layer comprises a modulus of 80 $N/mm^2$.

5. A turbomachine blade as claimed in claim 1 wherein the damping layer is 1.0 mm thick.

6. A turbomachine blade as claimed in claim 1 wherein the damping layer is between 0.05 and 3.0 mm thick.

7. A turbomachine blade as claimed in claim 1 wherein the first damping layer comprises a modulus of 10 $N/mm^2$.

8. A turbomachine blade as claimed in claim 1 wherein the first damping layer comprises a modulus between 0.5 and 100 $N/mm^2$.

9. A turbomachine blade as claimed in claim 1 wherein the stiffening core comprises a modulus of 1000 $N/mm^2$.

10. A turbomachine blade as claimed in claim 1 wherein the stiffening core comprises a modulus between 200 and 10000 $N/mm^2$.

11. A turbomachine blade as claimed in claim 1 wherein at least three damping layers are provided.

12. A turbomachine blade as claimed in claim 11 wherein the modulus of each successive damping layer increases when moving from the interior surface to the core.

13. A turbomachine blade as claimed in claim 1 wherein the vibration damping layer comprises a polymer.

14. A turbomachine blade as claimed in claim 13 wherein the polymer is a polymer blend comprising Bisphenol A-Epochlorohydrin, an amine hardener and branched polyurethane.

15. A turbomachine blade as claimed in claim 1 wherein the vibration damping material comprises a structural hardener.

16. A turbomachine blade as claimed in claim 1 wherein the vibration damping layer comprises a liquid crystal siloxane polymer.

17. A turbomachine blade as claimed in claim 1 wherein the stiffening core comprises a syntactic material.

18. A turbomachine blade as claimed in claim 1 wherein the stiffening core comprises Bisphenol A-Epochlorohydrin mixed with an aliphatic polyamine.

19. A turbomachine blade as claimed in claim 18 wherein the stiffening core comprises strengthening fibres from the group comprising glass, carbon, amide or modified amide.

20. A turbomachine blade as claimed in claim 1 wherein the vibration damping and stiffening system contains glass microspheres, polymer microspheres or a mixture of glass microspheres and polymer microspheres.

21. A turbomachine blade as claimed in claim 1 wherein the turbomachine blade is a compressor blade or a fan blade.

22. A turbomachine blade as claimed in claim 1 wherein the concave and convex metal wall portions comprise titanium or a titanium alloy.

23. A turbomachine blade as claimed in claim 1 wherein the root portion comprises a dovetail root or a firtree root.

24. A gas turbine engine comprising a turbomachine blade as claimed in claim 1.

25. A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material, the vibration damping material being bonded to the at least one internal surface and wherein a vibration damping and stiffening system comprises a variation of material properties between the wall portions wherein the vibration damping and stiffening system comprises a material that increases in stiffness from the interior surfaces to the centre of the hollow interior wherein the vibration damping and stiffening system comprises a material that decreases in density from the interior surfaces to the centre of the hollow interior.

26. A turbomachine blade as claimed in claim 25 wherein the vibration damping and stiffening system comprises a syntactic material.

* * * * *